US009140149B2

(12) United States Patent
Park

(10) Patent No.: US 9,140,149 B2
(45) Date of Patent: Sep. 22, 2015

(54) CONTINUOUSLY VARIABLE VALVE LIFT/TIMING APPARATUS

(71) Applicant: Hyundai Motor Company, Seoul (KR)

(72) Inventor: Byung Ok Park, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/143,635

(22) Filed: Dec. 30, 2013

(65) Prior Publication Data

US 2015/0068475 A1 Mar. 12, 2015

(30) Foreign Application Priority Data

Sep. 6, 2013 (KR) ..... 10-2013-0107417

(51) Int. Cl.
*F01L 1/34* (2006.01)
*F01L 1/18* (2006.01)

(52) U.S. Cl.
CPC ..... *F01L 1/34* (2013.01); *F01L 1/18* (2013.01)

(58) Field of Classification Search
CPC ..... F01L 1/34; F01L 1/18
USPC ..... 123/90.15, 90.16, 90.39, 90.44, 90.27
See application file for complete search history.

(56) References Cited

U.S. PATENT DOCUMENTS

| | | | | |
|---|---|---|---|---|
| 8,079,334 | B2 | 12/2011 | Park | |
| 2009/0241874 | A1* | 10/2009 | Lee | 123/90.16 |
| 2009/0288622 | A1* | 11/2009 | Kwon et al. | 123/90.16 |
| 2010/0095918 | A1* | 4/2010 | Cecur | 123/90.16 |
| 2010/0154731 | A1* | 6/2010 | Park | 123/90.16 |

FOREIGN PATENT DOCUMENTS

| | | | |
|---|---|---|---|
| KR | 10-2009-0064088 | A | 6/2009 |
| KR | 10-2009-0105054 | A | 10/2009 |
| KR | 10-2010-0064913 | A | 6/2010 |
| KR | 10-2010-0064974 | A | 6/2010 |
| KR | 10-1086506 | B1 | 11/2011 |

* cited by examiner

*Primary Examiner* — Ching Chang
(74) *Attorney, Agent, or Firm* — Morgan, Lewis & Bockius LLP

(57) ABSTRACT

A continuously variable valve lift/timing apparatus includes: a cam provided on a camshaft; a swing arm rotatable about a first end connected to a cylinder head and includes a second end; an actuating arm which includes: a rotation shaft rotatably coupled to the second end; an output cam coupled to the rotation shaft and has an output surface; and an input roller connected to the rotation shaft and comes into contact with the cam, and of which a relative distance with respect to the rotation shaft is variable; a valve opening and closing unit which comes into contact with the output surface so as to be opened and closed; a swing arm control unit which varies a relative position of the second end; and a lift timing control unit which varies a relative position of the input unit.

13 Claims, 9 Drawing Sheets

CONTINUOUSLY VARIABLE VALVE LIFT/TIMING APPARATUS

CROSS-REFERENCE TO RELATED APPLICATION

The present application claims priority of Korean Patent Application Number 10-2013-0107417 filed Sep. 6, 2013, the entire contents of which application is incorporated herein for all purposes by this reference.

BACKGROUND OF INVENTION

1. Field of Invention

The present invention relates to a continuously variable valve lift/timing apparatus, and more particularly, to a continuously variable valve lift/timing apparatus capable of independently controlling a valve lift and valve timing in accordance with an operational state of an engine.

2. Description of Related Art

An internal combustion engine produces power by receiving fuel and air in a combustion chamber and combusting fuel and air.

When air is sucked, an intake valve is operated by an operation of a camshaft, and air is sucked into the combustion chamber while the intake valve is opened.

In addition, an exhaust valve is operated by an operation of the camshaft, and air is discharged from the combustion chamber while the exhaust valve is opened.

However, optimal operations of the intake valve and the exhaust valve are varied in accordance with a rotation speed of an engine.

A proper lift or proper valve opening and closing timing is varied in accordance with the rotation speed of the engine.

In order to implement a proper valve operation in accordance with the rotation speed of the engine, various researches have been conducted.

For example, a variable valve lift (VVL) apparatus or a continuously variable valve lift (CVVL) apparatus implemented so that the valve is operated with another lift in accordance with revolutions per minute of an engine, and a variable valve timing (VVT) apparatus which opens and closes the valve at proper timing in accordance with revolutions per minute of the engine have been researched.

FIG. 9 is a view for explaining lift variation of a general continuously variable valve lift/timing apparatus.

Referring to FIG. 9, in the general continuously variable valve lift apparatus, when a valve lift is varied, in accordance with a rise in a lift profile, the valve timing is advanced as illustrated in FIG. 9A, the valve timing is fixed as illustrated in FIG. 9B, or the valve timing is retarded, as illustrated in FIG. 9C.

The reason is that in the case of the general continuously variable valve lift apparatus, the timing according to the lift is determined by an initial design, and the same timing is always formed at the same lift in accordance with a mechanical configuration.

The information disclosed in this Background section is only for enhancement of understanding of the general background of the invention and should not be taken as an acknowledgement or any form of suggestion that this information forms the prior art already known to a person skilled in the art.

BRIEF SUMMARY

Various aspects of the present invention provide for a continuously variable valve lift/timing apparatus capable of independently controlling a valve lift and valve timing in accordance with an operational state of an engine.

Various aspects of the present invention provide for a continuously variable valve lift/timing apparatus including a cam which is provided on a camshaft, a swing arm which is rotatable about a first end connected to a cylinder head and includes a second end, an actuating arm which includes a rotation shaft which is rotatably coupled to the second end, an output cam which is coupled to the rotation shaft and has an output surface, and an input roller which is connected to the rotation shaft and comes into contact with the cam, and of which a relative distance with respect to the rotation shaft is variable, a valve opening and closing unit which comes into contact with the output surface so as to be opened and closed, a swing arm control unit which varies a relative position of the second end, and a lift timing control unit which varies a relative position of the input roller.

The actuating arm may include: a guide arm which is formed on the rotation shaft and has a hydraulic chamber formed therein; and a guide rod which supports the input roller, is inserted into the hydraulic chamber, and is relatively movable along the guide arm in accordance with hydraulic pressure supplied by the hydraulic chamber.

The actuating arm may further include an elastic unit which is provided in the hydraulic chamber and elastically supports the guide rod.

The lift timing control unit may include a control flow path which is formed in the rotation shaft and selectively supplies hydraulic pressure to the hydraulic chamber.

The swing arm control unit may include: a control shaft which is provided to be parallel to the camshaft; and a control arm which is connected to the control shaft and comes into contact with the second end, in which the control arm varies a relative position of the second end in accordance with a rotation of the control shaft.

The number of output cams may be two.

The number of valve opening and closing units may be two, such that each of the valve opening and closing units comes into contact with the output cam so as to be opened and closed, and the valve opening and closing unit may include: a first valve opening and closing unit which includes a contact surface which comes into contact with the output surface; and a second valve opening and closing unit which includes an opening and closing unit swing arm, and a swing arm roller which is provided at the opening and closing unit swing arm and comes into contact with the output surface.

The output surfaces of the output cams may have different profiles.

Various aspects of the present invention provide for a continuously variable valve lift/timing apparatus including: a cam which is provided on a camshaft; a swing arm which is rotatable about a first end connected to a cylinder head and includes a second end; an actuating arm which includes: a rotation shaft which is rotatably coupled to the second end; an output cam which is coupled to the rotation shaft and has an output surface; an input roller which is connected to the rotation shaft and comes into contact with the cam, and of which a relative distance with respect to the rotation shaft is variable; a guide arm which is formed to protrude on the rotation shaft and has a hydraulic chamber formed therein; a guide rod which supports the input roller, is inserted into the hydraulic chamber, and is relatively movable along the guide arm in accordance with hydraulic pressure supplied by the hydraulic chamber; and an elastic unit which is provided in the hydraulic chamber and elastically supports the guide rod; a valve opening and closing unit which comes into contact with the contact surface so as to be opened and closed; and a swing arm control unit which varies a relative position of the second end.

The swing arm control unit may include: a control shaft which is provided to be parallel to the camshaft; and a control arm which is connected to the control shaft and comes into contact with the second end, in which the control arm varies a relative position of the second end in accordance with a rotation of the control shaft.

The number of output cams may be two.

The number of valve opening and closing units may be two, such that each of the valve opening and closing units comes into contact with the output cam so as to be opened and closed, and the valve opening and closing unit may include: a first valve opening and closing unit which includes a contact surface which comes into contact with the output surface; and a second valve opening and closing unit which includes an opening and closing unit swing arm, and a swing arm roller which is provided at the opening and closing unit swing arm and comes into contact with the output surface.

The output surfaces of the output cams may have different profiles.

According to the continuously variable valve lift/timing apparatus according to various aspects of the present invention, the valve lift and the valve timing may be independently controlled in accordance with an operational state of the engine, thereby implementing various valve lifts and various valve timings.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
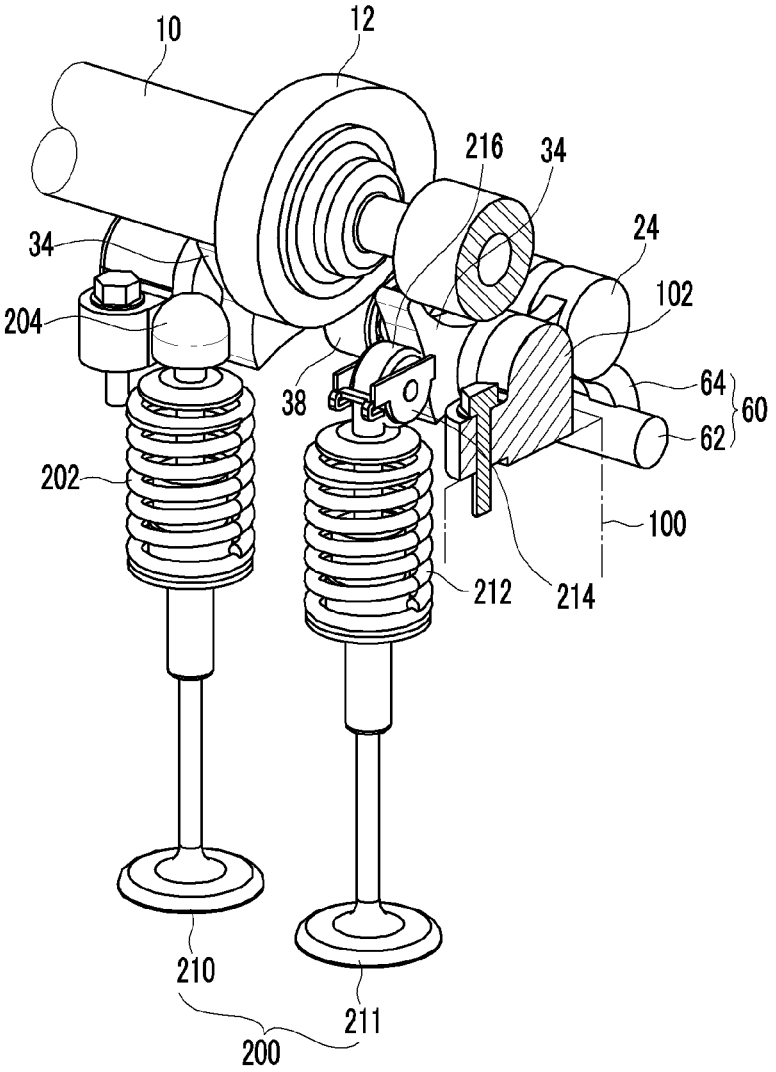
FIG. 1 is a perspective view of an exemplary continuously variable valve lift/timing apparatus according to the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Like reference numerals refer to like elements throughout the specification.

In the drawings, thicknesses are enlarged to clearly express various portions and areas.

It will be understood that when an element such as a layer, film, region, or substrate is referred to as being "on" another element, it can be directly on the other element or intervening elements may also be present.

In contrast, when an element is referred to as being "directly on" another element, there are no intervening elements present.

Throughout the specification and the claims, unless explicitly described to the contrary, the word "comprise" and variations such as "comprises" or "comprising" will be understood to imply the inclusion of stated elements but not the exclusion of any other elements.

Figure 2:
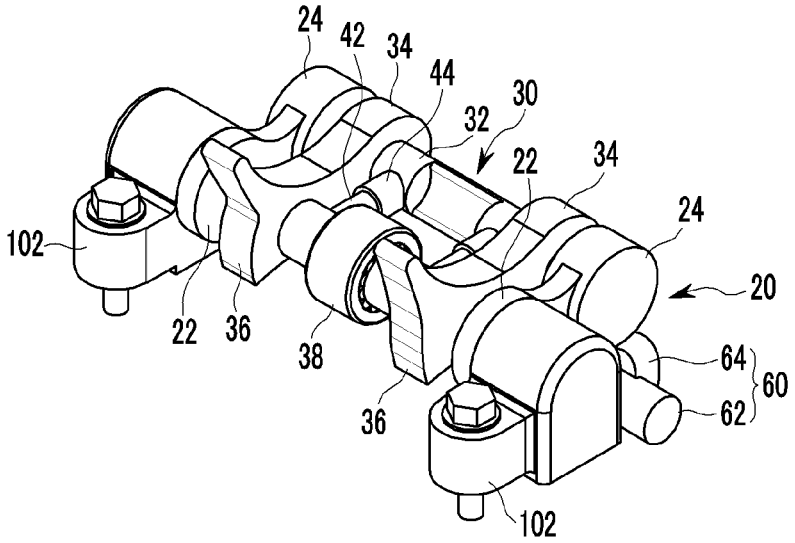
FIG. 2 is a perspective view illustrating a swing arm and an actuating arm that are applied to an exemplary continuously variable valve lift/timing apparatus according to the present invention.

FIG. 1 is a perspective view of a continuously variable valve lift/timing apparatus according to various embodiments of the present invention, and FIG. 2 is a perspective view illustrating a swing arm and an actuating arm that are applied to the continuously variable valve lift/timing apparatus according to various embodiments of the present invention.

Figure 3:
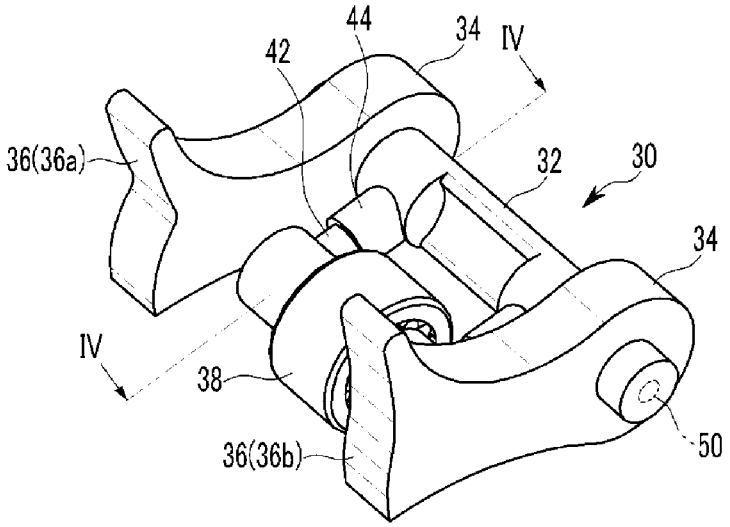
FIG. 3 is a perspective view illustrating an advanced timing mode of the actuating arm that is applied to the continuously variable valve lift/timing apparatus according to the present invention.
Figure 4A:
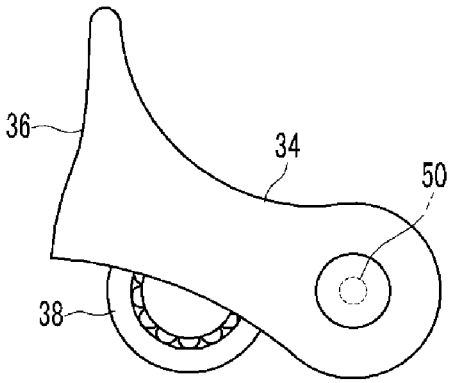
FIG. 4A and FIG. 4B are views for explaining an advanced timing mode of the actuating arm that is applied to the continuously variable valve lift/timing apparatus according to the present invention.
Figure 4B:
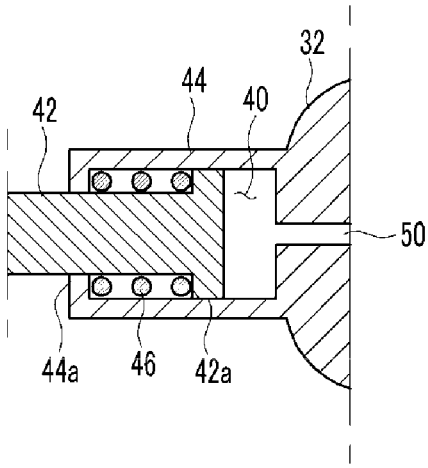

FIG. 3 is a perspective view illustrating an advanced timing mode of the actuating arm that is applied to the continuously variable valve lift/timing apparatus according to various embodiments of the present invention, and FIG. 4 is a view for explaining an advanced timing mode of the actuating arm that is applied to the continuously variable valve lift/timing apparatus according to various embodiments of the present invention.

Referring FIGS. 1 to 4, a continuously variable valve lift/timing apparatus according to various embodiments of the present invention may include: a cam 12 which is provided on a camshaft 10; a swing arm 20 which is rotatable about a first end 22 connected to a cylinder head 100 and includes a second end 24; a rotation shaft 32 which is rotatably coupled to the second end 24; an actuating arm 30 which includes: an output cam 34 which is coupled to the rotation shaft 32 and has an output surface 36; and an input roller 38 which is connected to the rotation shaft 32 and comes into contact with the cam 12, and of which a relative distance with respect to the rotation shaft 32 is variable; a valve opening and closing unit 200 which comes into contact with the output surface 36 so as to be opened and closed; a swing arm control unit 60 which varies a relative position of the second end 24; and a lift timing control unit which varies a relative position of the input unit.

The first end 22 of the swing arm 20 is connected to the cylinder head 100 by a mounting bracket 102.

The actuating arm 30 may include: a guide arm 44 which is formed to protrude on the rotation shaft 32 and has a hydraulic chamber 40 formed therein; and a guide rod 42 which supports the input roller 38, is inserted into the hydraulic chamber 40, and is relatively movable along the guide arm 44 in accordance with hydraulic pressure supplied by the hydraulic chamber 40.

In addition, the actuating arm 30 may further include an elastic unit 46 which is provided in the hydraulic chamber 40 and elastically supports the guide rod 42.

The lift timing control unit includes a control flow path 50 which is formed in the rotation shaft 32 and selectively supplies hydraulic pressure to the hydraulic chamber 40.

The swing arm control unit 60 includes: a control shaft 62 which is provided to be parallel to the camshaft 10; and a control arm 64 which is connected to the control shaft 62 and comes into contact with the second end 24, and the control arm 64 may vary a relative position of the second end 24 in accordance with a rotation of the control shaft 62.

The number of output cams 34 may be two, and the number of valve opening and closing units 200 may be two, such that each of the valve opening and closing units 200 comes into contact with the output cam 34 so as to be opened and closed.

That is, as illustrated in FIG. 1, the valve opening and closing unit 200 may include: a first valve opening and closing unit 210 which includes a contact surface 204 which comes into contact with the output surface 36, and a valve spring 202; and a second valve opening and closing unit 211 which includes an opening and closing unit swing arm 214, and a swing arm roller 216 which is provided at the opening and closing unit swing arm 214 and comes into contact with the output surface 36, and a valve spring 212.

The output surfaces 36 of the output cams 34 may have different profiles 36*a* and 36*b*.

That is, the output surfaces 36 of the output cams 34 may have the different profiles 36*a* and 36*b* such that the first and second valve opening and closing units 210 and 211 may form different valve lift profiles. In addition, the first and second valve opening and closing units 210 and 211 may be provided as different type of valves, that is, as a pair of a tappet type valve and a swing arm type valve.

Therefore, a swirl is formed particularly in a low speed region of an engine by the different valve profiles, thereby improving air suction efficiency.

Figure 7:
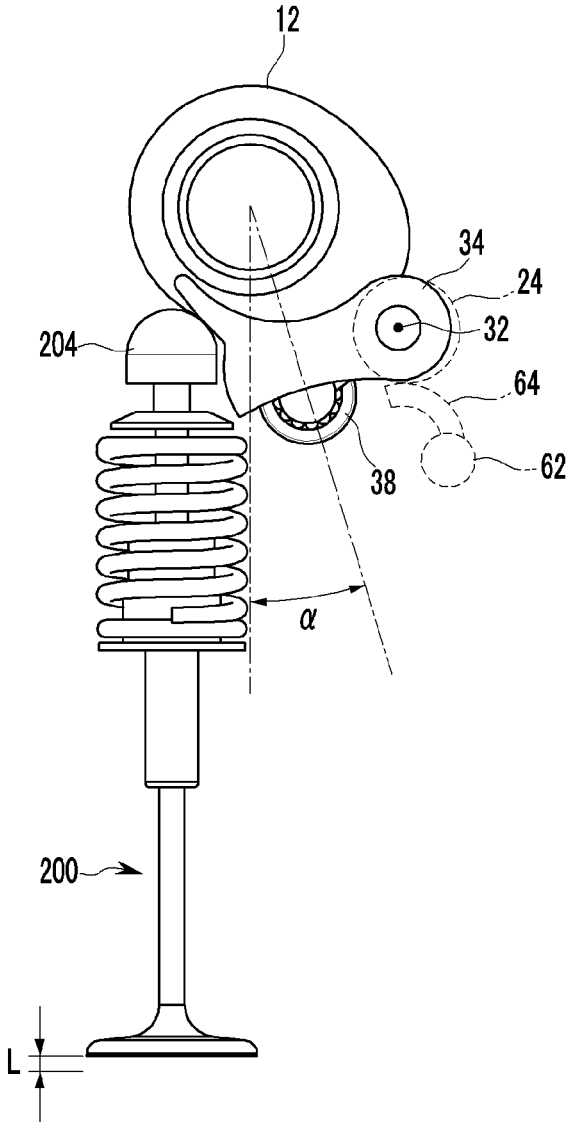
FIG. 7 and FIG. 8 are front views for explaining an operation of the continuously variable valve lift/timing apparatus according to the present invention.
Figure 8:
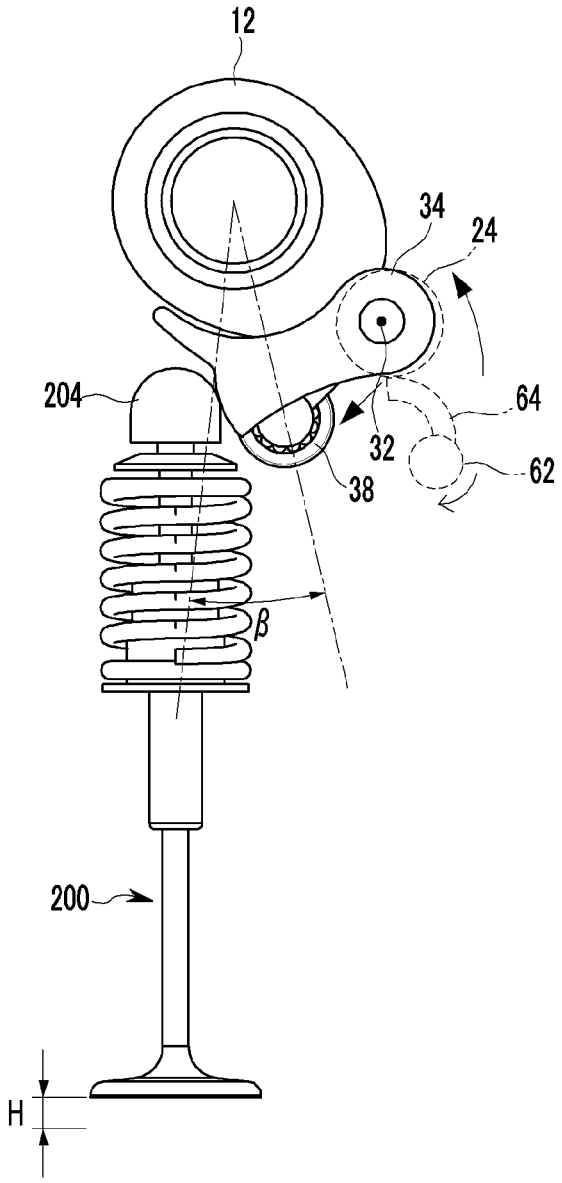
Figure 9A:
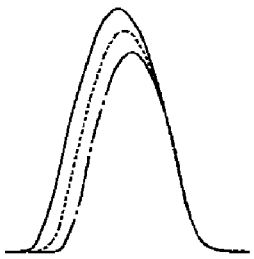
FIG. 9A, FIG. 9B and FIG. 9C are views for explaining lift variation of a general continuously variable valve lift/timing apparatus.
Figure 9B:
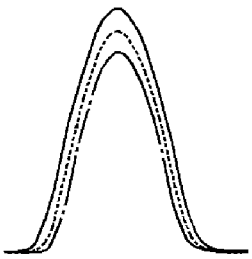
Figure 9C:
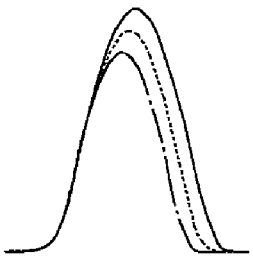

FIGS. 7 and 8 are front views for explaining an operation of the continuously variable valve lift/timing apparatus according to various embodiments of the present invention.

Here, a valve lift control operation of the continuously variable valve lift/timing apparatus according to various embodiments of the present invention will be described with reference to FIGS. 1 to 8.

FIG. 7 is a view illustrating an operation in a low lift mode of the continuously variable valve lift/timing apparatus, and FIG. 8 is a view illustrating an operation in a high lift mode of the continuously variable valve lift/timing apparatus.

When an operation mode is changed from the low lift mode to the high lift mode in accordance with an operational state of the engine, a non-illustrated control motor or actuator is rotated by control of a non-illustrated engine control unit (ECU) such that an operation angle of the control shaft 62 is changed.

Here, because an operation and a function of the ECU are obvious to those skilled in the technical field to which the present invention pertains, a detailed description thereof will be omitted.

Accordingly, the control arm 64 connected to the control shaft 62 is also rotated to push the second end 24 that is in contact with the control arm, and the swing arm 20 is rotated about the first end 22.

Accordingly, as illustrated in FIGS. 7 and 8, a relative position of the rotation shaft 32, which is a center of pivoting motion of the actuating arm 30, is changed.

Then, while a relative position where the cam 12 and the input roller 38 come into contact with each other is changed, a relative contact position between the output surface 36 and the valve opening and closing unit 200 is also changed, and a duration in which a valve lift of the valve opening and closing unit 200 is opened and a lift are increased.

Here, valve timing may be advanced or retarded in accordance with a variation in the valve lift depending on a length of the swing arm 20, a length of the control arm 64, a relative position of the rotation shaft 32, and the like.

In contrast, when the operation mode is changed from the high lift mode to the low lift mode in accordance with the operational state of the engine, the non-illustrated control motor or actuator is reversely rotated by control of the non-illustrated engine control unit (ECU) such that an operation angle of the control shaft 62 is changed, and a relative position of the rotation shaft 32 is changed as illustrated in FIG. 7.

While only a high lift and a low lift are illustrated as the valve lift for the convenience of understanding, the present invention is not limited thereto, and various valve lifts may be implemented in accordance with operational states of the engine.

Further, a non-illustrated torsion spring may be provided in the mounting bracket 102 so as to allow the second end 22 of the swing arm 20 to be always in contact with the control arm 64, or a spring may be provided to allow the second end 22 of the swing arm 20 to be always in contact with the control arm 64. A configuration of the torsion spring or the spring is obvious to those skilled in the technical field to which the present invention pertains, and thus a detailed description thereof will be omitted.

Figure 5:
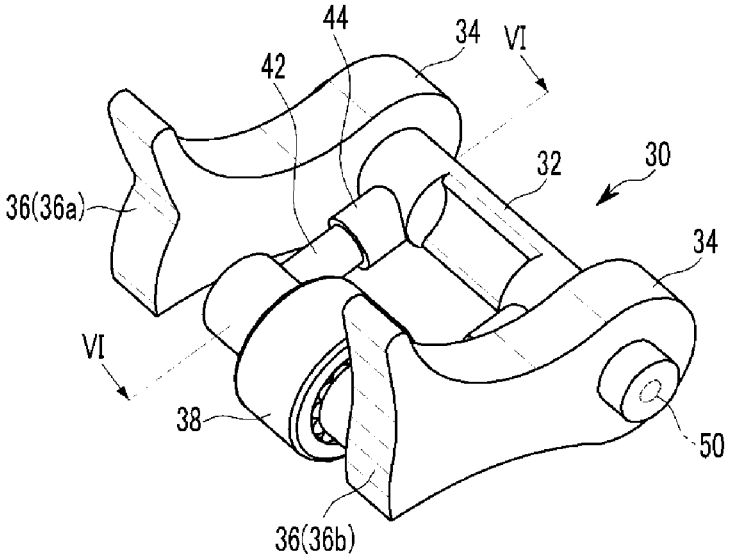
FIG. 5 is a perspective view illustrating a retarded timing mode of the actuating arm that is applied to the continuously variable valve lift/timing apparatus according to the present invention.
Figure 6A:
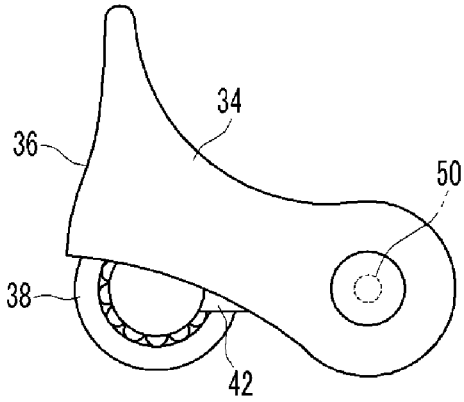
FIG. 6A and FIG. 6B are views for explaining the retarded timing mode of the actuating arm that is applied to the continuously variable valve lift/timing apparatus according to the present invention.
Figure 6B:
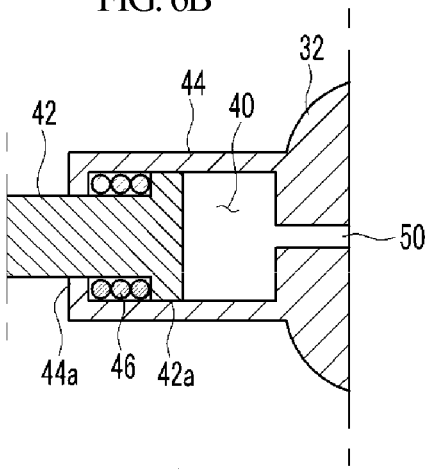

FIG. 5 is a perspective view illustrating a retarded timing mode of the actuating arm that is applied to the continuously variable valve lift/timing apparatus according to various embodiments of the present invention, and FIG. 6 is a view for explaining the retarded timing mode of the actuating arm that is applied to the continuously variable valve lift/timing apparatus according to various embodiments of the present invention.

Hereinafter, a valve timing control operation of the continuously variable valve lift/timing apparatus according to various embodiments of the present invention will be described with reference to FIGS. 1 to 8.

For the convenience of understanding, it is assumed that the cam 12 illustrated in FIGS. 1, 7, and 8 is rotated clockwise.

FIGS. 3 and 4 are views illustrating an advanced timing mode of the actuating arm that is applied to the continuously variable valve lift/timing apparatus according to various embodiments of the present invention, respectively.

In the advanced timing mode, hydraulic pressure is not supplied through the control flow path 50, and a relative distance between the input roller 38 and the rotation shaft 32 is decreased by elastic force of the elastic unit 46 that is provided between a protruding end 42*a* of the guide arm 44 and a protruding end 42*a* of the guide rod 42. Therefore, relative contact timing between a lobe of the cam 12 and the input roller 38 becomes advanced. Therefore, opening timing of the valve opening and closing unit 200 becomes relatively advanced.

FIGS. 5 and 6 are views illustrating a retarded timing mode of the actuating arm that is applied to the continuously variable valve lift/timing apparatus according to various embodiments of the present invention, respectively.

In the retarded timing mode, hydraulic pressure is supplied through the control flow path 50 such that a relative distance between the input roller 38 and the rotation shaft 32 is increased. Therefore, the relative contact timing between the input roller 38 and the lobe of the cam 12 becomes retarded. Therefore, the opening timing of the valve opening and closing unit 200 becomes relatively retarded.

Hereinafter, a lift change and a timing change of the continuously variable valve lift/timing apparatus according to various embodiments of the present invention will be described with reference to FIGS. 7 and 8.

FIG. 7 is a view illustrating operations in the low lift mode and the advanced timing mode of the continuously variable valve lift/timing apparatus according to various embodiments of the present invention, and FIG. 8 is a view illustrating operations in the high lift mode and the retarded timing mode of the continuously variable valve lift/timing apparatus according to various embodiments of the present invention.

"α" and "β" depicted in the drawings refer to opening angles in the low lift mode and the high lift mode of the valve opening and closing unit 200 of the continuously variable valve lift/timing apparatus according to various embodiments of the present invention, respectively.

In the high lift mode, it can be seen that a relative distance between the input roller 38 and the cam 12 is decreased, and the valve opening angle β is increased more than the valve opening angle α in the low lift mode.

In addition, in the advanced timing mode, the relative position of the input roller 38 is moved counterclockwise such that the timing in which the input roller 38 and the lobe of the cam 12 come into contact with each other becomes relatively advanced.

While in the drawings, a combination of the low lift mode and the advanced timing mode and a combination of the high lift mode and the retarded timing mode of the continuously variable valve lift/timing apparatus according to various embodiments of the present invention are illustrated, this is just to illustrate only a partial exemplary embodiment for the convenience of understanding, and various combinations are possible.

For example, a combination of the low lift mode and the retarded timing mode is also possible, and a combination of the high lift mode and the advanced timing mode is also possible.

If the lift mode is changed from the low lift mode to the high lift mode, when a lift of the continuously variable valve lift/timing apparatus according to various embodiments of the present invention is advanced, and the valve timing is controlled so as to be retarded by an operation of the valve timing control unit, a configuration in which only the valve lift is changed without changing the valve timing is also possible.

As such, the continuously variable valve lift/timing apparatus according to various embodiments of the present invention may implement an optimal operational state in accordance with various operation conditions by independently controlling the valve lift and the valve timing in accordance with an operational state of the engine.

For convenience in explanation and accurate definition in the appended claims, the terms front and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve lift/timing apparatus comprising:

a cam provided on a camshaft;

a swing arm rotatable about a first end connected to a cylinder head and including a second end;

an actuating arm including a rotation shaft rotatably coupled to the second end, an output cam coupled to the rotation shaft and having an output surface, and an input roller connected to the rotation shaft and being in contact with the cam having a variable relative distance with respect to the rotation shaft;

a valve opening and closing device which is in contact with the output surface so as to open and close corresponding valves;

a swing arm control device which varies a relative position of the second end; and a lift timing control device which varies a relative position of the input roller.

2. The continuously variable valve lift/timing apparatus of claim 1, wherein the actuating arm includes:

a guide arm formed to protrude on the rotation shaft and has a hydraulic chamber formed therein; and a guide rod which supports the input roller, is inserted into the hydraulic chamber, and is relatively movable along the guide arm in accordance with hydraulic pressure supplied by the hydraulic chamber.

3. The continuously variable valve lift/timing apparatus of claim 2, wherein the actuating arm further includes an elastic device provided in the hydraulic chamber and elastically supports the guide rod.

4. The continuously variable valve lift/timing apparatus of claim 2, wherein the lift timing control device includes a control flow path formed in the rotation shaft and selectively supplies hydraulic pressure to the hydraulic chamber.

5. The continuously variable valve lift/timing apparatus of claim 1, wherein the swing arm control device includes:

a control shaft provided to be parallel to the camshaft; and a control arm connected to the control shaft and being in contact with the second end;

wherein the control arm varies a relative position of the second end in accordance with a rotation of the control shaft.

6. The continuously variable valve lift/timing apparatus of claim 1, wherein the number of output cams is two.

7. The continuously variable valve lift/timing apparatus of claim 6, wherein the output surfaces of the output cams have different profiles.

8. The continuously variable valve lift/timing apparatus of claim 1, wherein the number of valve opening and closing devices is two, such that each of the valve opening and closing devices are in contact with the output cam so as to open and close a corresponding valve, and the valve opening and closing device includes:

a first valve opening and closing device which includes a contact surface which is in contact with the output surface; and a second valve opening and closing device which includes an opening and closing device swing arm, and a swing arm roller provided at the opening and closing device swing arm and being in contact with the output surface.

9. A continuously variable valve lift/timing apparatus comprising:

a cam provided on a camshaft;

a swing arm rotatable about a first end connected to a cylinder head and including a second end;

an actuating arm including a rotation shaft rotatably coupled to the second end, an output cam coupled to the rotation shaft and has an output surface, an input roller connected to the rotation shaft that is in contact with the cam and having a variable relative distance with respect to the rotation shaft, a guide arm protruding on the rotation shaft and has a hydraulic chamber formed therein, a guide rod which supports the input roller, is inserted into the hydraulic chamber, and is relatively movable along the guide arm in accordance with hydraulic pressure supplied by the hydraulic chamber, and an elastic device provided in the hydraulic chamber and elastically supports the guide rod;

a valve opening and closing device which is in contact with the output surface so as to open and close corresponding valves; and a swing arm control device which varies a relative position of the second end.

10. The continuously variable valve lift/timing apparatus of claim 9, wherein the swing arm control device includes:

a control shaft provided to be parallel to the camshaft; and a control arm connected to the control shaft and being in contact with the second end;

wherein the control arm varies a relative position of the second end in accordance with a rotation of the control shaft.

11. The continuously variable valve lift/timing apparatus of claim 9, wherein the number of output cams is two.

12. The continuously variable valve lift/timing apparatus of claim 11, wherein the number of valve opening and closing devices is two, such that each of the valve opening and closing devices is in contact with the output cam so as to open and close a corresponding valve, and the valve opening and closing device includes:

a first valve opening and closing device which includes a contact surface which is in contact with the output surface; and a second valve opening and closing device which includes an opening and closing device swing arm, and a swing arm roller provided at the opening and closing device swing arm and being in contact with the output surface.

13. The continuously variable valve lift/timing apparatus of claim 11, wherein the output surfaces of the output cams have different profiles.

* * * * *